US005775424A

United States Patent [19]

Pemberton et al.

[11] Patent Number: 5,775,424

[45] Date of Patent: Jul. 7, 1998

[54] DEPTH-DISCRETE SAMPLING PORT

[76] Inventors: Bradley E. Pemberton, 131 Glencarin Dr., Aiken, S.C. 29803; Christopher P. May, 5002 Hesperus Dr., Columbia, Md. 21044; Joseph Rossabi, 105 Michael Ct., Aiken, S.C. 29801; Brian D. Riha, 238C Broad St., Augusta, Ga. 30909; Ralph L. Nichols, 812 Plantation Point Dr., North Augusta, S.C. 29841

[21] Appl. No.: 676,427

[22] Filed: Jul. 8, 1996

[51] Int. Cl.[6] ..... E21B 49/10

[52] U.S. Cl. ..... 166/264; 73/152.23; 73/152.24; 73/863.31; 166/370

[58] Field of Search ..... 166/250.01, 264, 166/370, 242.6; 73/152.23, 152.24, 863, 863.31, 863.51, 863.52, 863.83

[56] References Cited

U.S. PATENT DOCUMENTS

| | | | |
|---|---|---|---|
| 3,254,710 | 6/1966 | Jensen | 166/264 |
| 3,323,361 | 6/1967 | Lebourg | 73/152.23 |
| 3,915,727 | 10/1975 | Sparlin | 166/294 X |
| 4,230,180 | 10/1980 | Patton et al. | 166/264 X |
| 4,439,062 | 3/1984 | Kingsbury | 405/270 X |
| 4,465,382 | 8/1984 | Burkhardt et al. | 405/270 X |
| 4,538,683 | 9/1985 | Chulick | 166/264 |
| 4,637,462 | 1/1987 | Grable | 166/245 |
| 4,651,824 | 3/1987 | Gradle | 166/245 |
| 4,697,953 | 10/1987 | Nussbaumer et al. | 405/128 |
| 4,745,801 | 5/1988 | Luzier | 73/152.23 |
| 4,860,544 | 8/1989 | Krieg et al. | 405/130 X |
| 4,974,425 | 12/1990 | Krieg et al. | 405/130 X |
| 5,017,233 | 5/1991 | Gouvenot | 405/270 X |
| 5,050,386 | 9/1991 | Krieg et al. | 405/130 X |
| 5,293,931 | 3/1994 | Nichols et al. | 166/264 X |
| 5,481,927 | 1/1996 | Hubbell et al. | 166/264 X |

*Primary Examiner*—George A. Suchfield
*Attorney, Agent, or Firm*—Hardaway Law Firm PA

[57] ABSTRACT

A sampling port is provided which has threaded ends for incorporating the port into a length of subsurface pipe. The port defines an internal receptacle which is in communication with subsurface fluids through a series of fine filtering slits. The receptacle is in further communication through a bore with a fitting carrying a length of tubing there which samples are transported to the surface. Each port further defines an additional bore through which tubing, cables, or similar components of adjacent ports may pass.

2 Claims, 3 Drawing Sheets

DEPTH-DISCRETE SAMPLING PORT

BACKGROUND OF THE INVENTION

1. Field of the Invention

The present invention relates to an apparatus and process for the collection of subsurface water and/or soil gas samples and transporting those samples to a surface for analysis and study. In particular, the present invention relates to a novel apparatus for collecting simultaneous samples from multiple locations within a single bore hole. The United States Government has rights on this invention pursuant to contract number DE-AC09-89SR18035 between the U.S. Department of Energy and Westinghouse Savannah River Company.

2. Discussion of Background

Soil and groundwater contamination are ranked among the most serious pollution problems of the industrialized nations. It is estimated that over 15% of community drinking water supplies in the United States are contaminated with chlorinated hydrocarbons.

A number of methods are available for treating contaminated soil and groundwater. However, any such treatment method requires monitoring and sampling of gas and/or water samples from the subsurface. Currently, sampling techniques are a very labor intensive activity. Therefore, there is room for improvement in the arts directed towards an improved apparatus and process for the collection of subsurface fluid samples.

SUMMARY OF THE INVENTION

The present invention is directed towards an apparatus and method for collecting subsurface fluid samples from a single test bore or well. The apparatus includes a collection port for sampling subsurface fluids. The port further defines a conduit through the port which allows information lines and collection lines to pass through each individual port such that a number of ports can be arranged in a stacked vertical fashion within a single bore or well.

In the past, a single segment of screened pipe was lowered or inserted to a desired depth for the collection of a subsurface fluid sample taken along the screen zone of the pipe. Samples from varying depths required separate subsurface bores to be established for additional sampling an expensive undertaking. Accordingly, the accumulation of data and samples from multiple depths was time consuming and expensive.

SUMMARY OF THE INVENTION

It is therefore an object of this invention to provide an apparatus and a method for collecting subsurface fluid samples from a single bore or well.

A further and more particular object of this to provide an apparatus and method for the simultaneous collection of multiple samples from varying depths within a single subsurface bore.

It is a further and more particular object of this invention to provide a number of vertically spaced collection ports, each port maintaining independent collection and sampling integrity and further providing a passage-way for collection lines and communication cables of other ports.

These as well as other objects of this invention are provided by a sampling port for the collection of subsurface fluids comprising:

a cylindrical housing having a threaded male end and a threaded female end, said female end further defining a receptacle within said housing, said receptacle in communication with a longitudinal bore traversing said housing and said bore in further communication with an upper surface of said first end.

a plurality of slits defined by an exterior portion of said housing, each said slit in communication with a second bore having a first bore end terminating within said housing and a second bore end in communication with said upper surface;

a fitting having a first end in communication with said second bore at said upper surface and a second end in communication with a length of flexible tubing.

DETAILED DESCRIPTION

Figure 1:
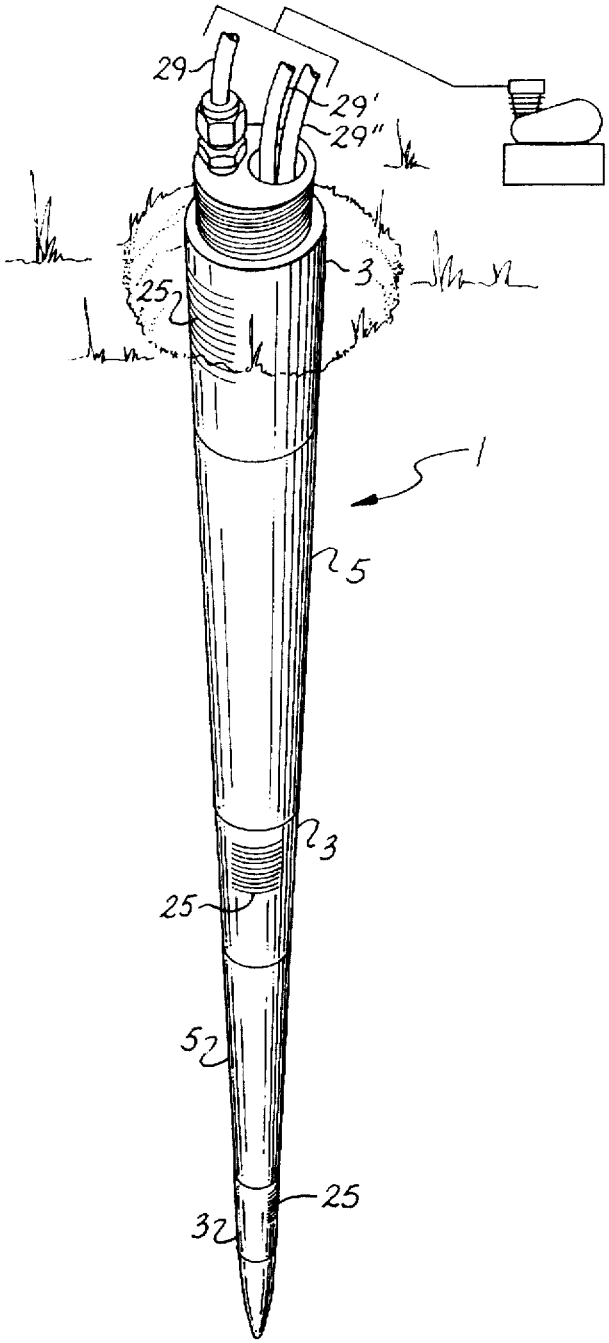
Figure 2:
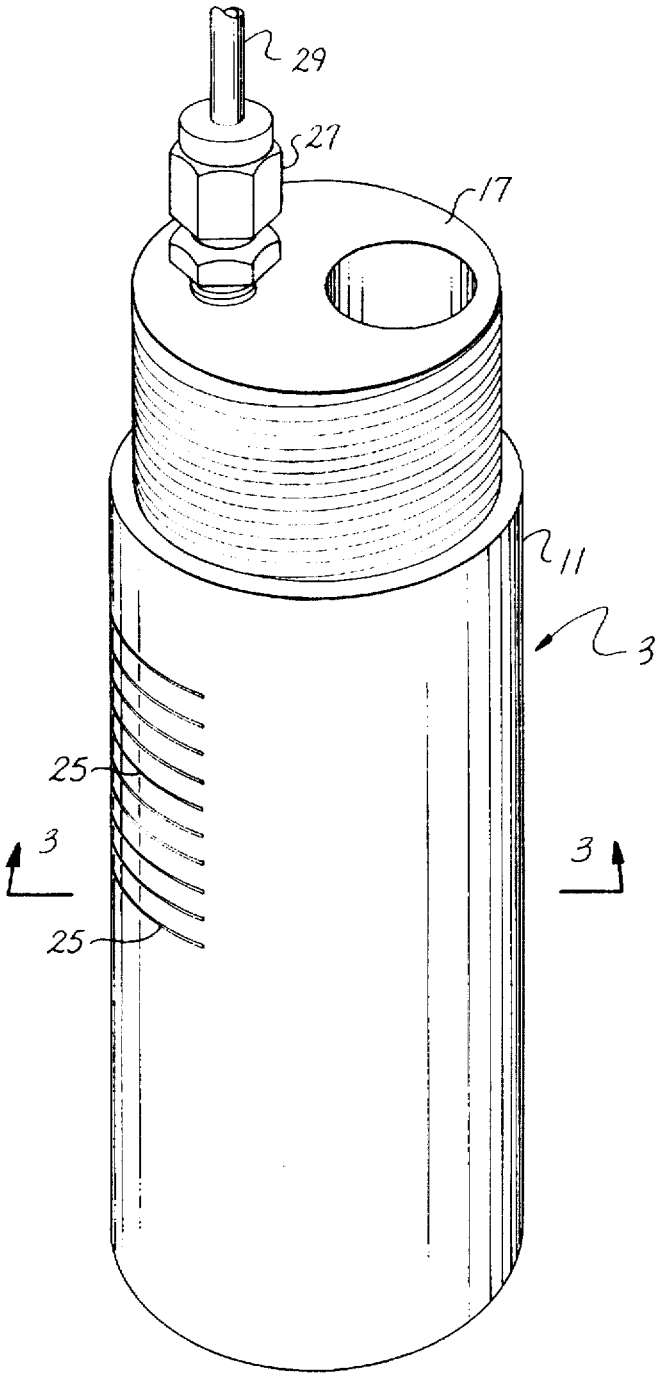
Figure 3:
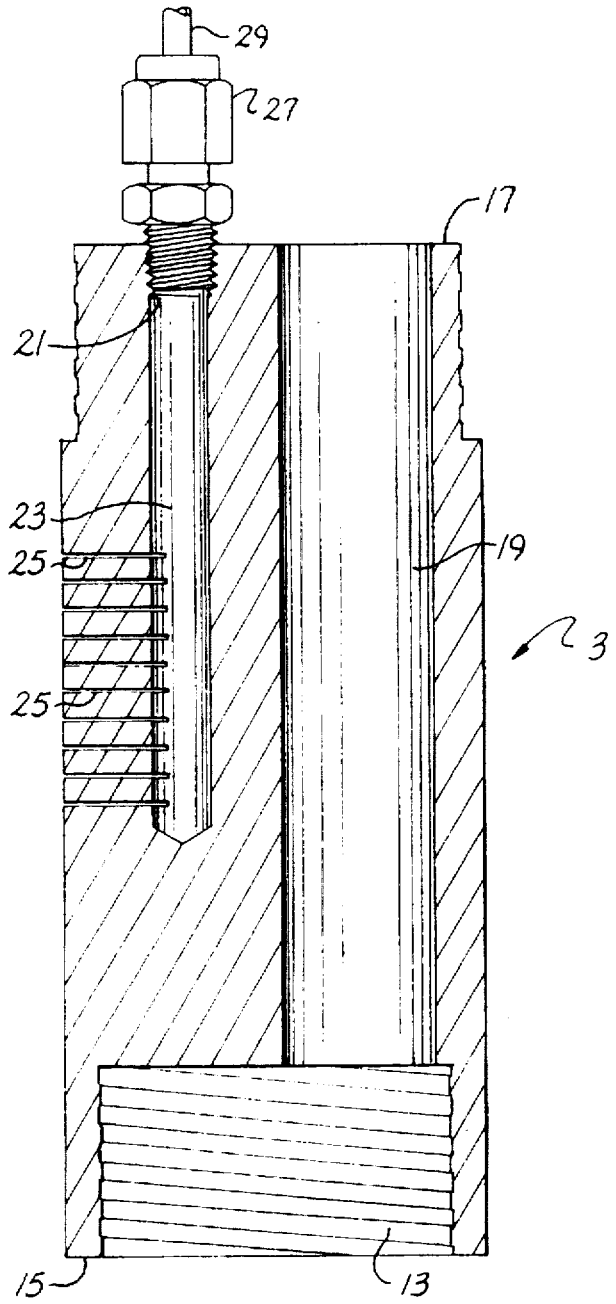

As seen in reference to FIG. 1, a collection assembly 1 comprises a plurality of individual cylindrical sampling ports 3 positioned-between lengths of PVC or other similar piping 5. In reference to FIG. 2 & 3, a single sampler port 3 is provided having a threaded male end 11 and a threaded female receptacle 13 defined by a second end 15.

An upper surface 17 of end 11 defines a bore 19 which is in further communication with female receptacle 13. Bore 19 provides a passage-way for electrical cables, fiber optics, and tubing to pass through each port 3. A second bore 21 is defined in part by upper surface 17 and in further communication with a chamber 23 defined within said port and above said receptacle 13. Chamber 23 is in communication with an exterior of the port through a plurality of fine slits 25 which traverse an exterior wall of the port and communicate with second bore 21, thereby providing the chamber 23.

A compression fitting 27 is carried by bore 21, fitting 27 used to connect a tubing 29. A free end of tubing 29 passes through the upper length of PVC pipe 5. Where an additional port 3 is present, tubing 29 passes through the respective bore 19 of each such port until tubing 29 reaches the surface.

Assembly 1 provides a plurality of sampler ports 3 in which each port can be operated independently of the other sampling ports within the assembly. The number of ports carried within a single assembly is largely a function of the diameter of the assembly. The inner diameter of bore 19 provides an upper limit upon the number of cables, tubing, and other materials which may be carried within the bore. Once bore 19 is filled, no additional ports can be installed between the surface and the uppermost port 3.

The present apparatus provides a number of advantages over prior art collection techniques and apparatuses. Multiple samples can be collected from known depths and which can be carried out simultaneously within a single well or test bore. Heretofore, separate bores are required for continuous sampling at different depths.

As best seen in and described in reference to U.S. patent application having Ser. No. 08/695,443, and having attorney docket number SRS-94,0035, filed May 13, 1996, a series of pressure sensitive valves and tubing may be used in conjunction with each sampling port which facilitates the rapid collection and in situ cleaning and reuse of the assembly and each port. The necessary valves and hardware for facilitating the process, as best described in reference to the above-identified patent application which is incorporated herein by reference, will reside within the PVC pipe portion above each port with the necessary tubing passing through the bore 19 of the upper ports 3.

It is therefore seen that an improved apparatus and process for obtaining samples of liquid and gas from subsurface soil is provided. It is also seen that the process and apparatus according to this invention is simple, versatile to use and can be used in a well or during cone penetrometer pushes to obtain multiple gas and liquid samples from multiple depths without the need for withdrawal of the equipment to collect the samples. It is further seen that the apparatus and process of this invention can be used for continuous sampling at separate, discrete depths. Many variations are embodied within the spirit and scope of the following appended claims.

That which is claimed is:

1. A process of collecting subsurface fluid samples comprising:

supplying a plurality of individual sampling ports, each said port carried vertically between a respective upper and a lower length of pipe to form a spaced vertical array of ports, each said port further defining a chamber in communication with an exterior of said port and in further communication with a first end of a fitting, a second end of said fitting in communication with a length of flexible tubing, each said port further defining a longitudinal bore traversing a length of each said port, thereby providing an uppermost port and a series of vertically spaced lower ports;

running said length of flexible tubing of each said lower ports through said longitudinal bore of said uppermost port and each intervening lower port;

inserting said spaced vertical array of ports into a subsurface bore;

applying a vacuum to said tubing of an individual port, thereby accumulating a subsurface fluid into said chamber and further into said tubing;

collecting said fluid from said tubing.

2. The process according to claim 1, wherein the step of applying said vacuum further comprises:

simultaneously applying a vacuum to said plurality of said tubing, thereby accumulating subsurface fluids into a corresponding number of said chambers and further into each said tubing.

* * * * *